United States Patent [19]

Dubourg

[11] Patent Number: 5,033,533

[45] Date of Patent: Jul. 23, 1991

[54] METHOD FOR PRODUCING A CONTAINER FOR CONTAMINATED METAL WASTE, AND A CONTAINER PRODUCED BY THIS METHOD

[75] Inventor: Michel F. P. Dubourg, Le Mesnil Saint Denis, France

[73] Assignee: Framatome, Courbevoie, France

[21] Appl. No.: 500,996

[22] Filed: Mar. 29, 1990

[30] Foreign Application Priority Data

Mar. 30, 1989 [FR] France ..... 89 04157

[51] Int. Cl.[5] ..... B22D 19/00

[52] U.S. Cl. ..... 164/98; 75/393; 252/633

[58] Field of Search ..... 164/98; 75/393; 252/633

[56] References Cited

U.S. PATENT DOCUMENTS 4,919,187 4/1990 Rupp et al. ..... 164/98

FOREIGN PATENT DOCUMENTS 59-204000 11/1984 Japan ..... 252/633
61-88199 5/1986 Japan ..... 252/633
62-27699 2/1987 Japan ..... 252/633

*Primary Examiner*—Kuang Y. Lin
*Attorney, Agent, or Firm*—Pollock, Vande Sande & Priddy

[57] ABSTRACT

A composite cast article (10) comprising contaminated metal waste is produced from a piece (1) of contaminated piping from a nuclear reactor to form the casting of the article (10), by fixing a bottom (3) on one end of the piece (1), pouring the previously remelted contaminated metal waste (5) into the article (10), and fixing a lid (4) on the other end of the piece (1).

5 Claims, 1 Drawing Sheet

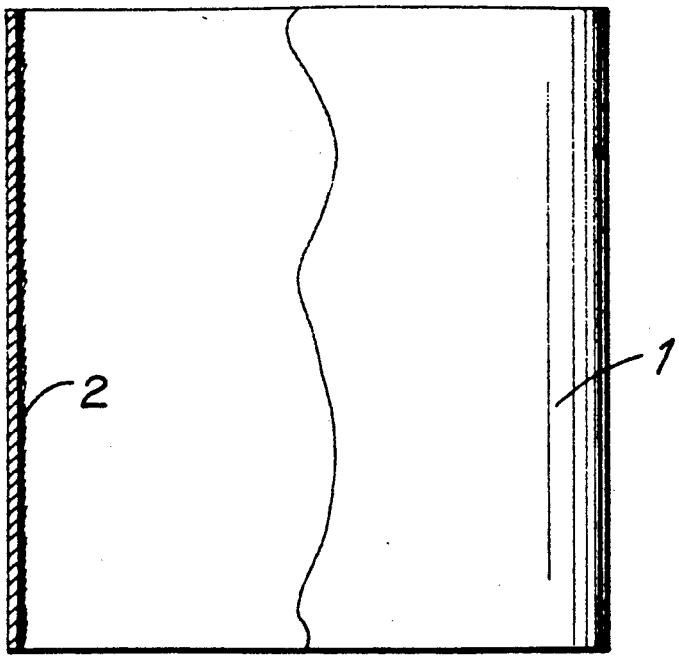
FIG.1
FIG.2
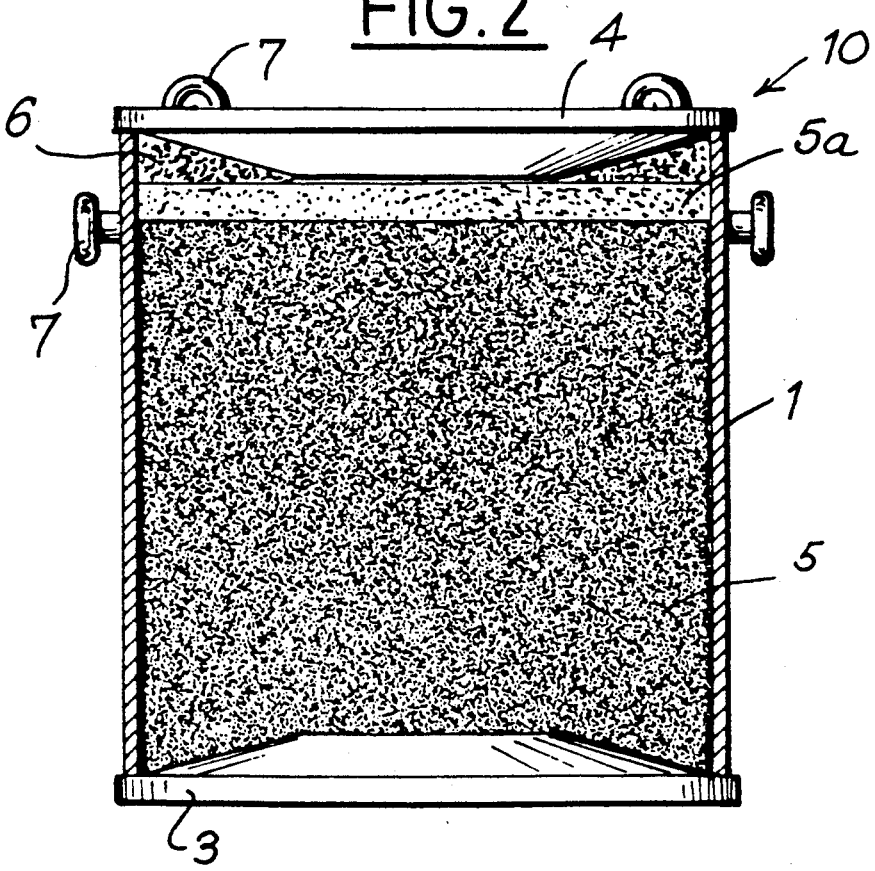

METHOD FOR PRODUCING A CONTAINER FOR CONTAMINATED METAL WASTE, AND A CONTAINER PRODUCED BY THIS METHOD

FIELD OF THE INVENTION

The invention relates to a method of producing a composite cast article comprising contaminated metal waste, as well as an article produced by such method.

BACKGROUND OF THE INVENTION

The definitive decommissioning of the first generating reactors of the graphite-gas type poses the problem of the storage and custody of slightly active or lightly contaminated waste which is generated in the course of the dismantling operations.

The dismantling of the first generating reactors will in fact produce some 12,000 tons of slightly contaminated metal waste per reactor, 8000 tons of which will come from the heat exchangers.

The contamination of nuclear reactor circuits is generally due to the redeposition of corrosion products carried by the primary fluid and activated in the core, then being redeposited on the inside walls of the circuits. Cobalt 60 is essentially found therein as radionuclide.

This contamination is also caused by fission products escaping through defective sheathing of the fuel elements. This type of contamination is occasional and varies greatly from one reactor to another, and the most characteristic radionuclide is cesium 137.

Metal waste produced by dismantling must usually be subjected to an operation for the decontamination of surfaces bathed by the heat transport fluid, in order to remove the only slightly adherent contamination, known as labile contamination.

The decontamination processes most commonly applied make use of mineral or organic chemical acids, or else foams or gels.

However, these processes generate substantial volumes of liquid effluents, which must be neutralized and treated.

In addition, the metal waste produced by dismantling is transferred, after fragmentation, to special containers for storage at sites for low-level activity waste.

As a rule, it is reckoned that a storage volume of 1 cubic meter is required for the storage of 500 to 800 kg of metal waste, which is considerable.

SUMMARY OF THE INVENTION

The object of the present invention is a method of producing a container for contaminated metal waste, which makes it possible to eliminate or to reduce the decontamination operations which generate large volumes of liquid effluents, and to recycle to industry waste material the specific decontamination of which is below the tolerated permissible limit threshold, which is, for example, 1 becquerel per gram in France, and 0.37 becquerel per gram in Germany and Great Britain.

The invention has as its object a method of producing a composite cast article comprising contaminated metal waste, in which use is made of a piece of contaminated piping from a nuclear reactor to form the casing of the article, a bottom is fixed on one end of the piece, the previously remelted contaminated metal waste is poured into the article, and a lid is fixed on the other end.

According to another characteristic of the invention, in addition to the contaminated metal waste, the melting slag is also poured into the article, and the entire contents are secured in position by cement at the top before the lid is fixed.

The present invention also has as an object an article produced by this method for contaminated metal waste.

According to another characteristic of the invention, the article constitutes an ingot usable in steelmaking as added metal or for the manufacture of products.

BRIEF DESCRIPTION OF THE DRAWINGS

In order that the invention may be more clearly understood, an embodiment thereof will now be described by way of example and with reference to the accompanying drawings.

FIG. 1 is a sectional view of a piece of piping from the primary circuit of a nuclear reactor.

FIG. 2 is a sectional view of an article according to the invention.

DESCRIPTION OF PREFERRED EMBODIMENT

During a operations of dismantling the nuclear reactor, slightly active or lightly contaminated metal waste is produced.

This is particularly so in the case of the primary circuit, where the typical surface contamination amounts to 74 becquerels per square centimeter with a diameter of 1600 millimeters and a thickness of 25 millimeters. Taking into account the specific dimensions of the piping forming the primary circuit, the specific activity of this piping is 3.8 becquerels per gram.

The method according to the invention consists in cutting up the primary circuit into pieces 1 (FIG. 1) of a length, for example, between 1.3 and 1.6 meters.

The piece 1 has on its inside wall a surface deposition 2 of activated corrosion products or radioactive fission products.

The piece 1 constitutes the casing of a container, which is given the general reference 10 and is illustrated in FIG. 2.

End plates are then cast to form a bottom 3 and a lid 4 for the container 10. For the purpose of making the bottom 3 and the lid 4 it is, for example, possible to use uncontaminated metal, such as the numerous piping supports which exist in a nuclear power station.

After this operation, the bottom 3 is fixed, for example by welding, on one end of the piece 1, and contaminated metal waste 5 from the nuclear power station is poured, after previous remelting, into the container 10. This contaminated metal waste is, for example, remelted in an induction furnace operating at mains frequency with a liquid heel, or at medium frequency without a liquid heel, with confinement of the environment by means of a hood and collection, through a battery of a plurality of serially arranged filters, of the dust produced by the fusion operation.

The metal melted in the furnace may also be converted into cast iron by the injection of graphite within the limit of 3% of metal mass.

The operation of pouring molten metal into the container 10 having been completed, the top lid 4 is fixed to the other end of the piece 1, for example by welding.

At this stage, there are two options.

If the poured metal has a low specific activity, lower than the permitted limit of 1 bequerel per gram, only the steel or cast iron is poured into the container 10, in order to form an ingot utilizable in steelmaking as added metal, as well as the manufacture of products.

If the poured metal has considerable activity, higher than the permitted limit of 1 becquerel per gram, the molten metal 5 and the melting slag 5*a* are poured into the container 10, and the entire contents are secured in position by cement 6 at the top before the lid 4 is fastened (FIG. 2).

This results in a highly compact assembly which entails no risk of radioactive dispersion, since the outside of the container is not contaminated.

Holding rings 7 can also be provided on the outside of the piece 1 and on the lid 4, for the transport of the container.

The method according to the present invention permits a reduction of the volume occupied by the remelted waste, in comparison with waste stored loose in containers, a saving of storage space by a factor between 7 and 15, and consequently a reduction of storage and custody costs. It also enables the preliminary decontamination operations for only slightly contaminated structures to be eliminated or reduced, and therefore permits a reduction of the volume of liquid effluents generated.

Furthermore, this method also permits a dilution of activity deposited on the surface in the volume of the metal matrix thus obtained, and an increase of radiological protection through self-absorption.

In addition, elements such as cesium will migrate into the dust slag, while the cobalt 60 remains firmly fixed in the metal matrix.

The present invention is also applicable to contaminated materials coming from plants other than those using generating reactors of the graphite-gas type; it is also appropriate for the dismantling of reactors of the water-cooled type.

I claim:

1. Method of producing a composite cast article (10) comprising contaminated metal waste, wherein use is made of a piece (1) of contaminated piping from a nuclear reactor to form a casing of said article (10), said method comprising the steps of (a) fixing a bottom (3) on a first end of said piece (1);

(b) pouring previously remelted contaminated metal waste (5) into said article; and (c) fixing a lid (4) on a second end of said piece (1).

2. Method according to claim 1, wherein in addition to said contaminated metal waste (5), melting slag (5*a*) is also poured into said article, including the further step of securing the entire content in position by cement (6) at the top before fixing said lid (4).

3. Composite cast article comprising contaminated metal waste, produced by the method of any one of claims 1 to 2.

4. Composite cast article comprising contaminated metal waste, produced by the method of claim 1, wherein said article constitutes an ingot used in steelmaking as added metal.

5. Composite cast article comprising contaminated metal waste, produced by the method of claim 1, wherein said article constitutes an ingot used in the production or products.

* * * * *